US005491059A

United States Patent [19]

Whitcomb

[11] Patent Number: 5,491,059

[45] Date of Patent: Feb. 13, 1996

[54] SILVER CARBOXYLATE COMPOUNDS AS SILVER SOURCES IN PHOTOTHERMOGRAPHIC AND THERMOGRAPHIC ELEMENTS

[75] Inventor: David R. Whitcomb, Woodbury, Minn.

[73] Assignee: Minnesota Mining and Manufacturing Company, St. Paul, Minn.

[21] Appl. No.: 331,683

[22] Filed: Oct. 31, 1994

[51] Int. Cl.[6] ..... G03C 1/498

[52] U.S. Cl. ..... 430/618; 430/617; 430/619

[58] Field of Search ..... 430/618, 620, 430/619, 203, 223, 224, 617

[56] References Cited

U.S. PATENT DOCUMENTS

| | | | |
|---|---|---|---|
| 3,330,663 | 7/1967 | Weyde et al. . | |
| 3,554,750 | 1/1971 | Weyde et al. . | |
| 4,259,424 | 3/1981 | Endo et al. . | |
| 4,670,374 | 6/1987 | Bellus et al. | 430/617 |
| 4,943,515 | 7/1990 | Okazaki et al. . | |
| 4,994,352 | 2/1991 | Strandjord et al. . | |

FOREIGN PATENT DOCUMENTS 54131922 10/1979 Japan .

OTHER PUBLICATIONS

"Solutions of Soaps in Organic Solvents" by Wahid U. Malik, Ajay K. Jain, and O. P. Jhamb, Chemical Laboratories, University of Roorkee, Roorkee, UP. India, J. Chem Soc. (A), 1971.

"Silver(I) Phenoxyalkanoates: the Crystal and Molecular Structures of catena –[Bis–u–(phenoxyacetato–O–O)–disilver (I)] and Bis [bis–u–(4–fluorophenoxyacetato–O, O)–bis{acquasilver(I)}]" by Graham Smith, Dalius S. Sagatys, Craig A. Campbell, Daniel E. Lynch and Colin H. L. Kennard., Department of Chemistry, Queensland University of Technology, Brisbane, QLD. Aust J. Chem., 1990, 43, 1707–12.

*Primary Examiner*—Thorl Chea

*Attorney, Agent, or Firm*—Gary L. Griswold; Walter N. Kirn; Mark A. Litman

[57] ABSTRACT

Silver carboxylates which can serve as the silver source in a black-and-white thermographic or photothermographic element or as the oxidizing agent for a dye-based thermographic or photothermographic color-imaging construction can be represented by the general formula;

$$R^3—X—(CH_2—CH_2—X)_n—L—CR^1R^2—COO^{-+}Ag$$

wherein:

$R^1$ and $R^2$ are each independently hydrogen, halogen, alkyl, substituted alkyl, aromatic, or substituted aromatic;

$R^3$ is an alkyl group, an aryl group, or $L—CR^1R^2—COO^{-+}Ag$;

L is a linking group that links $CR^1R^2$ to X;

X is selected from the group consisting of O, S, and $NR^4$, wherein $R^4$ is chosen from alkyl, substituted alkyl, aromatic, or substituted aromatic; and n is an integer from 0 to 12.

22 Claims, No Drawings

SILVER CARBOXYLATE COMPOUNDS AS SILVER SOURCES IN PHOTOTHERMOGRAPHIC AND THERMOGRAPHIC ELEMENTS

BACKGROUND OF THE INVENTION

1. Field of the Invention:

This invention relates to the use of novel silver carboxylate compounds in black-and-white and color photothermographic and thermographic imaging elements.

2. Background to the Art:

Silver halide-containing, photothermographic imaging materials (i.e., heat-developable photographic elements) processed with heat, and without liquid development, have been known in the art for many years. These materials, also known as "dry silver" compositions or emulsions, generally comprise a support having coated thereon: (a) a photosensitive material that generates silver atoms when irradiated; (b) a non-photosensitive, reducible silver source; (c) a reducing agent (i.e., a developer) for the silver ion (e.g., that silver ion in the non-photosensitive, reducible silver source); and (d) a binder.

The photosensitive material is generally photographic silver halide that must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms ($Ag^{\circ}$) are a catalyst for the reduction of silver ions, and that the photosensitive silver halide can be placed into catalytic proximity with the non-photosensitive, reducible silver source in a number of different fashions. For example, catalytic proximity can be accomplished by partial metathesis of the reducible silver source with a halogen-containing source (see, for example, U.S. Pat. No. 3,457,075); by coprecipitation of silver halide and the reducible silver source material (see, for example, U.S. Pat. No. 3,839,049); and other methods that intimately associate the photosensitive, photographic silver halide and the non-photosensitive, reducible silver source.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms (i.e., the latent image). At elevated temperatures, in the presence of the latent image, the non-photosensitive reducible silver source (e.g., silver behenate) is reduced by a reducing agent for silver ion. This produces a black-and-white image of elemental silver.

The reducing agent for the organic silver salt, often referred to as a "developer," may be any material, preferably organic material, that can reduce silver ion to metallic silver. While conventional photographic developers such as methyl gallate, hydroquinone, substituted-hydroquinones, hindered phenols, catechol, pyrogallol, ascorbic acid, and ascorbic acid derivatives are useful, hindered bisphenol reducing agents have traditionally been preferred.

As the visible image in black-and-white photothermographic elements is produced entirely by elemental silver ($Ag^{\circ}$), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic element. Another method of increasing the maximum image density in photographic and photothermographic emulsions without increasing the amount of silver in the emulsion layer is by incorporating dye-forming materials (e.g., leuco dyes) in the emulsion. Upon imaging, the dye-forming material is oxidized, and a dye and a reduced silver image are simultaneously formed in the exposed region. In this way, a dye-enhanced silver image can be produced.

A number of methods have been proposed for obtaining color images with dry silver systems. One method includes incorporating dye-forming coupler materials into the dry silver systems. Color-forming dry silver systems may include a combination of organic silver compound, a magenta, yellow, or cyan dye-forming coupler, an aminophenol developing agent, a base release agent such as guanidinium trichloroacetate, and silver bromide in poly(vinyl butyral). For example, color-forming dry silver systems may comprise a combination of silver behenate, a 2-equivalent or a 4-equivalent yellow, magenta or cyan dye-forming coupler, a sulfonamidophenol developing agent, an amine such as n-octadecylamine, and silver bromoiodide in poly(vinyl butyral).

Color images can also be formed by incorporation of dye forming or dye releasing compounds into the emulsion. Upon imaging, the dye forming or dye releasing material is oxidized and a dye and a reduced silver image are simultaneously formed in the exposed region. For example, leuco dye compounds are often incorporated into the emulsion. A leuco dye is the reduced form of a color-bearing dye. It is generally colorless or very lightly colored. Upon imaging, the leuco dye is oxidized and a dye and a reduced silver image are simultaneously formed in the exposed region.

Multicolor photothermographic imaging elements typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic elements having at least two or three distinct color-forming emulsion layers are disclosed in U.S. Pat. Nos. 4,021,240 and 4,460,681. Various methods to produce dye images and multicolor images with leuco dyes are well known in the art as represented by U.S. Pat. Nos. 3,180,731;

3,531,286; 3,761,270; 4,022,617; 4,460,681; 4,883,747; and Research Disclosure March 1989, item 29963.

Thermographic imaging constructions (i.e., heat-developable materials), imaged and processed with heat and without liquid development, are widely known in the imaging arts and rely on the use of heat to help produce an image. These elements generally comprise a support (such as paper, plastics, metals, glass, and the like) having coated thereon: (a) a thermally-sensitive, reducible silver source; (b) a reducing agent for the thermally-sensitive, reducible silver source (i.e., a developer); and (c) a binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, silver behenate is reduced by a reducing agent for silver ion such as methyl gallate, hydroquinone, substituted-hydroquinones, hindered phenols, catechol, pyrogallol, ascorbic acid, ascorbic acid derivatives, and the like, whereby an image comprised of elemental silver is formed. When the reducing agent is a material that can be oxidized to form or release a dye, as for example, a leuco dye, a colored image is formed.

Many times, the thermographic construction is brought into contact with the thermal head of a thermographic recording apparatus, such as a thermal printer, thermal facsimile, and the like. In such instances, an anti-stick layer is coated on top of the imaging layer to prevent sticking of the thermographic construction to the thermal head of the apparatus utilized. The resulting thermographic construction is then heated to an elevated temperature, typically in the range of about 60°–225° C., resulting in the formation of an image.

The imaging arts have long recognized the fields of photothermography and thermography as being clearly distinct from that of photography. Photothermographic and thermographic elements significantly differ from conventional silver halide photographic elements which require wet-processing.

In photothermographic and thermographic imaging elements a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the development of the non-photosensitive, reducible silver source. In contrast, conventional wet-processed photographic elements use only one form of silver (e.g., silver halide) which, upon development, is converted to silver. Additionally, photothermographic elements require an amount of silver halide per unit area that is as little as one-hundredth of that used in a conventional wet-processed silver halide.

Photothermographic and thermographic systems employ a light-insensitive silver salt, such as silver behenate, which participates with the developer in developing the latent image. In contrast, photographic systems do not employ a light-insensitive silver salt directly in the image-forming process. As a result, the image in photothermographic and thermographic elements is produced primarily by reduction of the light-insensitive silver source (silver behenate) while the image in photographic black-and-white elements is produced primarily by the silver halide.

In photothermographic and thermographic elements, all of the "chemistry" of the system is incorporated within the element itself. For example, photothermographic and thermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions as compared to photographic emulsions. Even in so-called instant photography, developer chemistry is physically separated from the silver halide until development is desired. Much effort has gone into the preparation and manufacture of photothermographic and thermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic and thermographic elements the binder is capable of wide variation and a number of binders are useful in preparing these elements. In contrast, photographic elements are limited almost exclusively to hydrophilic binders such as gelatin.

Because photothermographic and thermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending on whether they have been incorporated in a photothermographic or thermographic element or incorporated in a photographic element.

Distinctions between photothermographic and photographic elements are described by D. H. Klosterboer in *Imaging Processes and Materials* (*Neblette's Eighth Edition*), J. Sturge et al. Ed, Van Nostrand Reinhold: New York, 1989, Chapter 9; and in *Unconventional Imaging Processes*, E. Brinckman et al., The Focal Press: London and New York, 1978, pp 74–75.

Light-sensitive recording materials suffer from a phenomenon known as halation which causes degradation in the quality of the recorded image. Such degradation occurs when a fraction of the imaging light which strikes the photosensitive layer is not absorbed, but instead passes through to the film base on which the photosensitive layer is coated. A portion of the light reaching the base may be reflected back to strike the photosensitive layer from the underside. Light thus reflected may, in some cases, contribute significantly to the total exposure of the photosensitive layer. Any particulate matter in the photosensitive element may also cause light passing through the element to be scattered. Scattered light which is reflected from the film base will, on its second passage through the photosensitive layer, cause exposure over an area adjacent to the point of intended exposure. This effect leads to image degradation. Silver-halide based photographic materials (including photothermographic materials) are prone to this form of image degradation since the photosensitive layers contain light-scattering particles (see, T. H. James, *The Theory of the Photographic Process*, Fourth Edition, MacMillan 1977, Chapter 20) and antihalation and acutance agents are often added to or coated with the photothermographic element. It would be desirable to have photothermographic materials with reduced light-scattering properties.

When coated onto transparent supports for viewing or projection, thermographic recording materials suffer from a phenomenon known as haze. Haze causes degradation in the quality of the viewed image and occurs when a fraction of the light which strikes the thermographic layer is not transmitted but instead is scattered. Any particulate matter in the thermographic element may cause light passing through the element to be scattered. Silver-based thermographic materials are prone to this form of image degradation since the thermally sensitive layers contain light-scattering particles such as silver salts.

Silver carboxylates which are light stable are well known to exhibit poor solubility in organic solvents at room temperature. As a result, when the silver carboxylate/organic solvent mixture is coated onto a substrate and dried, discrete particles (as opposed to a uniform distribution of molecules) of silver carboxylate are formed on the substrate. This limits their use as silver sources in photothermographic or thermographic elements requiting high transparency because, as discrete particles, such silver carboxylates cause light-scattering. The usual process of improving solubility in organic solvents by increasing the hydrocarbon chain length of the material to be dissolved provides no benefit in the case of silver carboxylates. Silver salts of carboxylic acids having a long alkyl chain (e.g., those having from 8 to 22 carbon atoms) have no better solubility than silver salts of carboxylic acids having a short alkyl chain. Accordingly, there remains a need for soluble silver carboxylate compounds for use in photothermographic and thermographic elements.

G. Smith, D. Sagatys, C. Campbell, D. Lynch, and C. Kennard, *Aust. J. Chemistry* 1990, 43, 1707 describe the molecular structure of a silver complex of substituted phenoxyacetates.

Japan Laid Open Patent Application JP 54-131922 (1978), discloses silver complexes of alkoxy derivatives of benzoic acid as liquid crystalline materials.

U.S. Pat. Nos. 3,330,663 and 3,554,750 disclose silver complexes of carboxylates containing thioether linkages as replacement materials for silver halide in photographic elements.

U.S. Pat. No. 4,994,352 discloses metal salts of carboxylic acids which may be substituted with alkoxy groups. These materials are incorporated with a light absorbing dye which enables the metal salt to be thermally decomposed. No specific benefits of alkoxy or polyalkoxy groups are noted.

U.S. Pat. No. 4,943,515 discloses an information recording system in which a dye complexes to a silver atom which is supplied by silver carboxylate complexes. The silver carboxylate compounds include phenoxy derivatives of acetic acid. No specific benefits of alkoxy or polyalkoxy groups are noted.

SUMMARY OF THE INVENTION

In accordance with the present invention, it has been discovered that certain novel silver carboxylates can serve as the silver source in a black-and-white thermographic or photothermographic element or as the oxidizing agent for a dye-based thermographic or photothermographic color-imaging construction. Such silver carboxylates exhibit increased solubility in the solvents used for preparing photothermographic and thermographic elements. Because of such increased solubility, when the silver carboxylate/solvent mixture is coated on a photothermographic or thermographic substrate and dried, the resulting emulsion layer will consist of individual silver carboxylate molecules evenly distributed throughout a binder. As compared with much larger silver carboxylate particles in the emulsion layer as has previously been the case, the more complete and finer distribution of the inventive silver carboxylates throughout the emulsion layer results in significantly less light scatter and, therefore, increased clarity.

The silver carboxylates of the present invention can be represented by the general formula;

$$R^3—X—(CH_2—CH_2—X)_n—L—CR^1R^2—COO^{-+}Ag \quad (I)$$

wherein:

$R^1$ and $R^2$ are each independently hydrogen, halogen, an alkyl group or an aryl group;

$R^3$ is an alkyl group, an aryl group, $L—CR^1R^2—COO^{-+}Ag$;

L is a linking group that links $CR^1R^2$ to X;

X is selected from the group consisting of O, S, and $NR^4$, wherein $R^4$ is chosen from alkyl, substituted alkyl, aromatic, or substituted aromatic; and n is an integer from 0 to 12.

Preferably, $R^1$ and $R^2$ are each independently hydrogen, an alkyl group of from 1–4 carbon atoms, an aryl group of from 5–6 carbon atoms, or a halogen group. More preferably, $R^1$ and $R^2$ are hydrogen.

$R^3$ is preferably an alkyl group of from 1–4 carbon atoms, or an aryl group of from 5–6 carbon atoms. More preferably, $R^3$ is an alkyl group of from 1–4 carbon atoms. Most preferably, $R^3$ is methyl or ethyl.

X is preferably O.

$R^4$ is preferably an alkyl group of from 1–4 carbon atoms. Most preferably, $R^4$ is methyl or ethyl.

Preferably, L is a single bond, $CH_2$, $CR^1R^2$, or an arylene group such as $C_6H_4$. More preferably, L is a single bond.

n is preferably an integer of from 0–5.

Depending on the selection of $R^3$ and $R^4$, it is preferred that the total number of atoms in the portion of the chain linked by L to $CR^1R^2$ be between about 14 and 22 (i.e., the atoms in L, X, carbon, hydrogen, and $R^3$).

Accordingly, one embodiment of the present invention provides heat-developable, photothermographic elements capable of providing stable, high density images of high resolution. These elements comprise a support bearing at least one photosensitive, image-forming, photothermographic emulsion layer comprising:

(a) a photosensitive silver halide;

(b) a non-photosensitive, reducible source of silver comprising a silver carboxylate compound of formula (I);

(c) a reducing agent for the non-photosensitive, reducible source of silver; and (d) a binder.

In a further embodiment, the present invention provides a thermographic element comprising a support coated with an imaging layer comprising:

(a) a non-photosensitive, reducible source of silver comprising a silver carboxylate compound of formula (I);

(b) a reducing agent for the non-photosensitive, reducible source of silver; and (c) a binder.

In both the inventive thermographic and photothermographic elements, the reducing agent for the non-photosensitive silver source may optionally comprise a compound capable of being oxidized to form a dye or to release a pre-formed dye. Preferably, the dye-forming material is a leuco dye.

As used herein, the term "emulsion layer" means a layer of a photothermographic element that contains photosensitive silver salt and silver source material. As used herein the term "photothermographic element" means a construction comprising at least one photothermographic emulsion layer and any supports, topcoat layers, blocking layers, etc.

Heating in a substantially water-free condition as used herein, means heating at a temperature of 80° to 250° C. The term "substantially water-free condition" means that the reaction system is in equilibrium with water in the air, and water for inducing or promoting the reaction is not particularly or positively supplied from the exterior to the element. Such a condition is described in T. H. James' *The Theory of the Photographic Process*, Fourth Edition, page 374.

As is well understood in this technical area, a large degree of substitution is not only tolerated, but is often advisable. As a means of simplifying the discussion and recitation of certain terminology used throughout this application, the terms "group" and "moiety" are used to differentiate between chemical species that allow for substitution or which may be substituted and those which do not so allow or may not be so substituted. Thus, when the term "group" is used to describe a chemical substituent, the described chemical material includes the basic group and that group with conventional substitution. Where the term "moiety" is used to describe a chemical compound or substituent, only an unsubstituted chemical material is intended to be included. For example, the phrase "alkyl group" is intended to include not only pure open-chain and cyclic saturated hydrocarbon alkyl substituents, such as methyl, ethyl, propyl, t-butyl, cyclohexyl, adamantyl, octadecyl, and the like, but also alkyl substituents beating further substituents known in the art, such as hydroxyl, alkoxy, vinyl, phenyl, halogen atoms (F, Cl, Br, and I), cyano, nitro, amino, carboxyl, etc. On the other hand, the phrase "alkyl moiety" is limited to the inclusion of only pure open-chain and cyclic saturated hydrocarbon alkyl substituents, such as methyl, ethyl, propyl, t-butyl, cyclohexyl, adamantyl, octadecyl, and the like. Substituents that react with active ingredients, such as very strongly electrophilic or oxidizing substituents, would of course be excluded by the ordinarily skilled artisan as not being inert or harmless.

Other aspects, advantages, and benefits of the present invention are apparent from the detailed description, the examples, and the claims.

DETAILED DESCRIPTION OF THE INVENTION

The silver carboxylates which can serve as the silver source in a black-and-white thermographic or photothermographic element or as the oxidizing agent for a dye-based thermographic or photothermographic color-imaging construction can be represented by the general formula:

$$R^3—X—(CH_2—CH_2—X)_n—L—CR^1R^2—COO^{-+}Ag \quad (I)$$

$R^1$ and $R^2$ are each independently hydrogen, halogen, an alkyl group, or an aryl group. It is preferred that $R^1$ and $R^2$ are hydrogen.

$R^3$ is an alkyl group, an aryl group, or $L—CR^1R^2—COO^{-+}Ag$. Preferably, $R^3$ is an alkyl group of from 1–4 carbon atoms, or an aryl group of from 5–6 carbon atoms. More preferably, $R^3$ is an alkyl group of from 1–4 carbon atoms. Most preferably, $R^3$ is methyl or ethyl.

L is a linking group that links $CR^1R^2$ to X. Preferably, L is a single bond, $CH_2$—, $CR^1R^2$, or an arylene group such as $C_6H_4$. More preferably L is a single bond.

X is selected from the group consisting of O, S, and $NR^4$, where $R^4$ is chosen from alkyl, substituted alkyl, aromatic, or substituted aromatic. X is preferably O. When X is $NR^4$, $R^4$ is preferably an alkyl group of from 1–4 carbon atoms. Most preferably, $R^4$ is methyl or ethyl.

n is an integer from 0 to 12; preferably from 0 to 5.

Depending on the selection of $R^3$ and $R^4$, it is preferred that the total number of atoms in the portion of the chain linked by L to $CR^1R^2$ be between about 14 and 22 (i.e., the atoms in L, X, carbon, hydrogen, and $R^3$). Generally, the longer the carboxylate chain is (i.e., the greater n is), the more soluble the compound of Formula (I) will be. Conversely, the longer the chain length of $R^1$–$R^4$ and/or the greater the number of aryl groups which $R^1$–$R^4$ represent, the less soluble the compound of Formula (I) is likely to be. Thus, one must strike a balance between these two ends to achieve a desired level of solubility.

The photosensitive element of the present invention comprises a support having at least one photosensitive image-forming, photothermographic emulsion layer comprising:

(a) a photosensitive silver halide;

(b) a non-photosensitive, reducible source of silver comprising a silver carboxylate compound of formula (I);

(c) a reducing agent for the non-photosensitive, reducible source of silver; and (d) a binder.

In another embodiment, the present invention provides a thermographic construction comprising a support coated with an imaging layer comprising:

(a) a non-photosensitive, reducible source of silver comprising a silver carboxylate compound of formula (I);

(b) a reducing agent for the non-photosensitive, reducible source of silver; and (c) a binder.

In both the inventive thermographic and photothermographic constructions, the reducing agent for the non-photosensitive silver source may optionally comprise a compound capable of being oxidized to form a dye or to release a pre-formed dye. Preferably, the dye-forming material is a leuco dye.

The silver carboxylate compounds of the present invention can be made according to methods of synthetic inorganic chemistry which will be apparent to those of ordinary skill in the art. For example, Compounds 1–5 are prepared by reaction of one molecule of a silver salt of an inorganic acid (i.e. a silver-nitrate) with one molecule of an alkali metal salt of an alkoxy-carboxylic acid. The preparation of such compounds is also detailed later in this application in Example 1.

Representative silver carboxylate compounds of the present invention are shown below. These representations are exemplary and are not intended to be limiting.

| | |
|---|---|
| Compound 1 | $C_2H_5—O—CH_2—COO^{-+}Ag$ |
| Com- | $C_4H_9—O—CH_2—COO^{-+}Ag$ |

-continued

| | |
|---|---|
| pound 2 | |
| Compound 3 | $Ag^{+}\,^{-}OOC—CH_2—O—CH_2—COO^{-}\,^{+}Ag$ |
| Compound 4 | $CH_3—O—CH_2CH_2—O—CH_2—COO^{-}\,^{+}Ag$ |
| Compound 5 | $CH_3—O—CH_2CH_2—O—CH_2CH_2—O—CH_2—COO^{-}\,^{+}Ag$ |

The silver carboxylate compounds of Formula (I) (including those shown above) are drawn as silver salts of carboxylic acids. In actual use, these silver carboxylate compounds are believed to form coordination complexes of two silver atoms with two carboxylate groups. Such a coordination complex can be represented by the following formula:

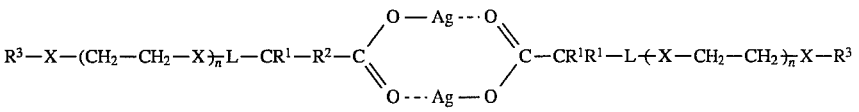

In addition to the silver carboxylate compounds of Formula (I) as described above, additional non-photosensitive organic silver salts may be used with the compounds of Formula (I). Such additional non-photosensitive organic silver salts are silver salts which are comparatively stable to light and which form a silver image by reacting with a reducing agent. Silver salts of organic acids, particularly silver salts of long chain fatty carboxylic acids, are preferred. The chains typically contain 10 to 30, preferably 15 to 28, carbon atoms.

The method used for making silver soap dispersions is well known in the art and is disclosed in *Research Disclosure* April 1983, item 22812, *Research Disclosure* October 1983, item 23419, and U.S. Pat. No. 3,985,565.

It is also effective to use an in situ process which comprises adding a halogen-containing compound to the silver carboxylate compound of Formula (I) and any additional organic silver salt to partially convert the silver of the silver carboxylate compound and any additional organic silver salt to silver halide.

When used in photothermographic elements of the present invention, the additional organic silver salt is preferably a silver salt which forms a silver image when heated to 80° C. or higher in the presence of an exposed photocatalyst (such as silver halide) and a reducing agent.

The photothermographic elements of this invention may be used to prepare black-and-white, monochrome, or full color images. The photothermographic element of this invention can be used, for example, in conventional black-and-white or color photothermography, in electronically-generated black-and-white or color hardcopy recording, in the graphic arts area, and in digital color proofing. The elements of this invention provide high photographic speed, strongly absorbing black-and-white or color images, and a dry and rapid process.

When used in photothermographic elements, the silver halide and the non-photosensitive reducible silver source material that form a starting point of development should be in catalytic proximity, i.e., reactive association. By "catalytic proximity" or "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

When used in a photothermographic element, the latent image obtained after exposure of the heat-sensitive construction can be developed by heating the material at a moderately elevated temperature of from about 80° C. to about 250° C. (176° F. to 482° F.) for about 1 second to 2 minutes. Exposure and development take place in a substantially water free condition after, or simultaneously with, image-wise exposure to form a black-and-white silver image.

When the reducing agent for the non-photosensitive silver source comprises a compound capable of being oxidized to form a dye or to release a pre-formed dye, a dye image is obtained simultaneously with the formation of a silver image either in exposed areas or in unexposed areas with exposed photosensitive silver halide.

When used in thermographic elements of the present invention, the additional organic silver salt is preferably a silver salt which forms a silver image when heated to 80° C. or higher in the presence of a reducing agent.

The thermographic elements of this invention can also be used to prepare black-and-white or monochrome images.

The total amount of non-photosensitive, reducible source of the silver (silver carboxylate compound of Formula (I) and, optionally, additional organic silver salt compounds) is preferably present in an amount of from 15 to 70 percent by weight of the emulsion layer. It is more preferably present at a level of 30 to 55 percent by weight of the emulsion layer.

The Photosensitive Silver Halide

As noted above, the present invention includes a photosensitive silver halide in the photothermographic construction. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic dodecahedral, orthrohombic, tetrahedral, other polyhedral habits, etc., and may have epitaxial growth of crystals thereon. Tabular grains are not prefered and are in fact least prefered crystal habits to be used in the photothermographic elements of the present invention. Narrow grain size distributions of truly tabular grains (e.g., with aspect ratios of 5:1 and greater) can not be readily provided by existing techniques with the prefered grain sizes of less than an average diamater size of 0.10 μm. There are grains refered to in the art as "tabular," "laminar," or "sigma" grains which may have aspect ratios of less than 5:1, such as disclosed in U.S. Pat. No. 4,806,461 which shows "tabular" twinned plane grains called laminar grains with aspect ratios equal to or greater than 2:1 with grain thickness of less than 0.5 μm and grain diameter averages of less than 0.3, but it is not clear that such grains are within the consideration of the ordinarily skilled artisan as laminar or tabular grains as much as they are merely definitions broadening the coverage of the terms without the conceptual benefits of the original disclosures of tabular grains in providing higher capture surface areas to volume ratios for the silver halide grains (e.g., higher projected areas per coating weight of grains as in U.S. Pat. Nos. 4,425,425 and 4,425,426).

The silver halide grains may have a uniform ratio of halide throughout; they may have a graded halide content, with a continuously varying ratio of, for example, silver bromide and silver iodide; or they may be of the core-shell type, having a discrete core of one halide ratio, and a discrete shell of another halide ratio. Core-shell type silver halide grains useful in photothermographic elements and methods of preparing these materials are described in allowed copending U.S. patent application Ser. No. 08/199,114 (filed Feb. 22, 1994). A core-shell silver halide grain having an iridium doped core is particularly preferred. Iridium doped core-shell grains of this type are described in copending U.S. patent application Ser. No. 08/239,984 (filed May 9, 1994).

The silver halide may be prepared ex situ, (i.e., be pre-formed) and mixed with the organic silver salt in a binder prior to use to prepare a coating solution. The silver halide may be pre-formed by any means, e.g., in accordance with U.S. Pat. No. 3,839,049. The silver halide may be pre-formed and mixed with the silver carboxylate compound of Formula (I) and any additional organic silver salt in a binder to prepare a coating solution. It is also effective to blend the silver halide, the silver carboxylate compound, and any additional organic silver salt in a ball mill or homogenize them in an homogenizer for a long period of time. Materials of this type are often referred to as "pre-formed emulsions." Methods of preparing silver halide and organic silver salts and manners of blending them are described in *Research Disclosure*, June 1978, item 17029; U.S. Pat. Nos. 3,700,458 and 4,076,539; and Japanese patent application Nos. 13224/74, 42529/76, and 17216/75.

Pre-formed silver halide emulsions when used in the material of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an in situ process, i.e., a process in which a halogen-containing compound is added to an organic silver salt to partially convert the silver of the organic silver salt to silver halide.

The light sensitive silver halide used in the present invention can be employed in a range of about 0.005 mole to about 0.5 mole; preferably, from about 0.01 mole to about 0.15 mole per mole; and more preferably, from 0.03 mole to 0.12 mole per mole of non-photosensitive reducible silver salt.

The silver halide used in the present invention may be chemically and spectrally sensitized in a manner similar to that used to sensitize conventional wet process silver halide or state-of-the-art heat-developable photographic materials. For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally about $10^{-10}$ to $10^{-1}$ mole; and preferably, about $10^{-8}$ to $10^{-3}$ moles per mole of silver halide.

The Reducing Agent for the Non-Photosensitive Reducible Silver Source

When used in black-and-white photothermographic and thermographic constructions the present invention comprises a reducing agent for the non-photosensitive reducible silver source material.

The reducing agent for the organic silver salt may be any material, preferably organic material, that can reduce silver ion to metallic silver. Conventional photographic developers such as methyl gallate, hydroquinone, substituted-hydroquinones, hindered phenols, catechol, pyrogallol, ascorbic acid, ascorbic acid derivatives, leuco dyes, etc. Hindered phenol reducing agents are preferred.

A wide range of reducing agents have been disclosed in dry silver systems including amidoximes, such as phenylamidoxime, 2-thienylamidoxime and p-phenoxyphenylamidoxime; azines, such as 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; a combination of polyhydroxybenzene and hydroxylamine; a reductone and/or a hydrazine, such as a combination of hydroquinone and bis(ethoxy-ethyl)hydroxylamine, piperidinohexose reductone, or formyl-4-methyl-phenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; bisphenols, such as bis(2-hydroxy-3-t-butyl-5-methylphenyl)methane, 1,1-bis(2-hydroxy-3,5-dimethyl-phenyl)-3,5,5-trimethylhexane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane; ascorbic acid derivatives, such as 1-ascorbylpalmitate and ascorbylstearate; unsaturated aldehydes and ketones; and 3-pyrazolidones (phenidones).

The reducing agent should be present as 1 to 10% by weight of the imaging layer. In multilayer constructions, if the reducing agent is added to a layer other than an emulsion layer, slightly higher proportions, of from about 2 to 15 wt %, tend to be more desirable.

The Optional Dye-Forming or Dye-Releasing Material

If desired, the reducing agent for the reducible source of silver may be a compound that can be oxidized directly or indirectly to form or release a dye.

The dye-forming or releasing material may be any colorless or lightly colored compound that can be oxidized to a colored form, when heated, preferably to a temperature of from about 80° C. to about 250° C. (176° F. to 482° F.) for a duration of from about 1 second to about 2 minutes. When used with a dye- or image-receiving layer, the dye can diffuse through emulsion layers and interlayers into the image-receiving layer of the element of the invention.

Leuco dyes are one class of dye-releasing material that form a dye upon oxidation. Any leuco dye capable of being oxidized by silver ion to form a visible image can be used in the present invention. Leuco dyes that are both pH sensitive and oxidizable can be used, but are not preferred. Leuco dyes that are sensitive only to changes in pH are not included within scope of dyes useful in this invention because they are not oxidizable to a colored form.

As used herein, the term "change in color" includes: (1) a change from an uncolored or lightly colored state (optical density less than 0.2) to a colored state (an increase in optical density of at least 0.2 units); and (2) a substantial change in hue.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the leuco or blocked leuco dyes (i.e., blocked dye-releasing compounds), absorb less strongly in the visible region of the electromagnetic spectrum than do the corresponding dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenic leuco dyes, such as indoaniline, indophenol, or azomethine leuco dyes; imidazole leuco dyes, such as 2-(3,5-di-t-butyl-4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

One class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open Patent Application No. 533,008. For a review of chromogenic leuco dyes, see K. Venkataraman, *The Chemistry of Synthetic Dyes*, Academic Press: New York, 1952; Vol. 4, Chapter VI.

Another class of leuco dyes useful in this invention are "aldazine" and "ketazine" leuco dyes. Dyes of this type are described in U.S. Pat. Nos. 4,587,211 and 4,795,697. Benzylidene leuco dyes are also useful in this invention. Dyes of this type are described in U.S. Pat. No. 4,923,792.

Yet another class of dye-releasing materials that form a diffusible dye upon oxidation are known as pre-formed-dye-release (PDR) or redox-dye-release (RDR) materials. In these materials, the reducing agent for the organic silver compound releases a mobile pre-formed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese Patent Application No. 165,054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 weight percent, and more preferably, in the range of 1–10 weight percent, based upon the total weight of each individual layer in which the reducing agent is employed.

The Binder

The photosensitive silver halide (when used), the non-photosensitive reducible source of silver (e.g., a silver alkoxy-carboxylate compound), the reducing agent, the optional leuco dye, and other addenda used in the present invention are generally added to at least one binder as described herein below.

The binder(s) that can be used in the present invention can be employed individually or in combination with one another. It is preferred that the binder be selected from polymeric materials, such as, for example, natural and synthetic resins and that the binder be sufficiently polar to hold the other ingredients of the emulsion in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as poly(vinyl alcohol), poly(vinyl pyrrolidone), acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers and terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders can be used individually or in combination with one another. Although the binder may be hydrophilic or hydrophobic, it is preferably hydrophobic.

Although the binder may be hydrophilic or hydrophobic, preferably it is hydrophobic in the silver containing layers. Optionally, the polymer binder may be used in combination of two or more thereof.

The binders are generally used at a level of from about 30 to about 90 percent by weight of the emulsion layer, and preferably, from about 45 to about 85 percent by weight. Where the proportions and activities of leuco dyes require a particular developing time and temperature, the binder should be able to withstand those conditions. Generally, it is preferred that the binder not decompose or lose its structural integrity at 20° F. (121° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic and Thermographic Formulations

The formulation for the photothermographic and thermographic emulsion layer can be prepared by dissolving and dispersing the binder, the photosensitive silver halide (when used), the non-photosensitive reducible source of silver (comprising the silver carboxylate compound of Formula (I) and, optionally, an additional organic silver salt compound), the reducing agent for the non-photosensitive reducible silver source (as, for example, the optional leuco dye), and optional additives, in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10 percent by weight of the emulsion layer, preferably from 0.1 to 10 percent by weight. Toners are well known materials in the photothermographic art as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylene-bis(1-carbamoyl-3,5-dimethylpyrazole), 1,8-(3,6-diazaoctane)bis(isothiuronium)trifluoroacetate, and2-(tribromomethylsulfonyl benzothiazole); merocyanine dyes such as 3-ethyl-5-[(3-ethyl-2-benzothiazolinylidene)-1-methyl-ethylidene]-2-thio-2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate(III), rhodium bromide, rhodium nitrate, and potassium hexachlororhodate(III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4-dione, and 6-nitro-1,3-benzoxazine-2,4-dione; pyrimidines and asym-triazines, such as 2,4-dihydroxypyrimidine, 2-hydroxy-4-aminopyrimidine, and azauracil; and tetrazapentalene derivatives, such as 3,6-dimercapto-1,4-diphenyl-1H, 4H-2,3a,5,6a-tetraazapentalene and 1,4-di(o-chlorophenyl)-3,6-dimercapto-1H, 4H-2,3a, 5,6a-tetraazapentalene.

When used in photothermographic elements, the photothermographic elements used in this invention may be further protected against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mercuric acetate and mereuric bromide.

Suitable antifoggants and stabilizers, which can be used alone or in combination, include the thiazolium salts described in U.S. Pat. Nos. 2,131,038 and 2,694,716; the azaindenes described in U.S. Pat. Nos. 2,886,437 and 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915.

Photothermographic and thermographic elements of the invention may contain plasticizers and lubricants such as polyalcohols, e.g., glycerin and diols of the type described in U.S. Pat. No. 2,960,404; fatty acids or esters such as those described in U.S. Pat. Nos. 2,588,765 and 3,121,060; and silicone resins such as those described in British Patent No. 955,061.

The photothermographic and thermographic elements of the present invention may include image dye stabilizers. Such image dye stabilizers are illustrated by U.K. Patent No. 1,326,889; and U.S. Pat. Nos. 3,432,300; 3,698,909; 3,574,627; 3,573,050; 3,764,337; and 4,042,394.

Photothermographic elements according to the present invention can further contain light-absorbing materials, antihalation, acutance, and filter dyes such as those described in U.S. Pat. Nos. 3,253,921; 2,274,782; 2,527,583; 2,956,879, 5,266,452, and 5,314,795. If desired, the dyes can be mordanted, for example, as described in U.S. Pat. No. 3,282,699.

Photothermographic and thermographic elements containing emulsion layers described herein may contain matting agents such as starch, titanium dioxide, zinc oxide, silica, and polymeric beads including beads of the type described in U.S. Pat. Nos. 2,992,101 and 2,701,245.

Emulsions in accordance with this invention may be used in photothermographic and thermographic elements which contain antistatic or conducting layers, such as layers that comprise soluble salts, e.g., chlorides, nitrates, etc., evaporated metal layers, ionic polymers such as those described in U.S. Pat. Nos. 2,861,056, and 3,206,312 or insoluble inorganic salts such as those described in U.S. Pat. No. 3,428,451.

Photothermographic and Thermographic Formulations and Constructions

The photothermographic and thermographic elements of this invention may be constructed of one or more layers on a support. Single layer constructions should contain the silver halide (when used), the non-reducible silver source material, the reducing agent, and binder as well as optional materials such as toners, dye-forming materials, coating aids, and other adjuvants. Two-layer constructions should contain silver halide (when used) and non-reducible silver source in one emulsion layer (usually the layer adjacent to the support) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic elements, the various emulsion layers are generally maintained distinct from each other by the use of functional or non-functional barrier layers between the various photosensitive layers as described in U.S. Pat. No. 4,460,681.

Photothermographic and thermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and, more preferably, in the range 0.5 to 2.5, as measured by a MacBeth Color Densitometer Model TD 504 using the color filter complementary to the dye color.

Additionally, it may be desirable in some instances to coat different emulsion layers on both sides of a transparent support, especially when it is desirable to isolate the imaging chemistries of the different emulsion layers.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

Alternatively, the formulation may be spray-dried or encapsulated to produce solid particles, which can then be redispersed in a second, possibly different, binder and then coated onto the support.

The formulation for the emulsion layer can also include coating aids such as fluoroaliphatic polyesters.

Development conditions will vary, depending on the construction used, but will typically involve heating the imagewise exposed material at a suitably elevated temperature.

When used in a photothermographic element, the latent image obtained after exposure of the heat-sensitive construction can be developed by heating the material at a moderately elevated temperature of, for example, about 80° C. to about 250° C., preferably from about 120° C. to about 200° C., for a sufficient period of time, generally from 1 second to 2 minutes. Heating may be carried out by the typical heating means such as a hot plate, an iron, a hot roller, a heat generator using carbon or titanium white, or the like.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

When used in a thermographic element, the image may be developed merely by heating at the above noted temperatures using a thermal stylus or print head, or by heating while in contact with a heat absorbing material.

The Support

Photothermographic and thermographic emulsions used in the invention can be coated on a wide variety of supports. The support or substrate can be selected from a wide range of materials depending on the imaging requirement. Supports may be transparent or opaque. Typical supports include polyester film, subbed polyester film, polyethylene terephthalate film, cellulose nitrate film, cellulose ester film, polyvinyl acetal film, polycarbonate film and related or resinous materials, as well as glass, paper, metal and the like. Typically, a flexible support is employed, especially a paper support, which can be partially acetylated or coated with baryta and/or an α-olefin polymer, particularly a polymer of an alpha-olefin containing 2 to 10 carbon atoms such as polyethylene, polypropylene, ethylene-butene copolymers, and the like. Preferred polymeric materials for the support include polymers having good heat stability, such as polyesters. A particularly preferred polyester is poly(ethylene terephthalate).

The support with backside resistive heating layer may also be used in color photothermographic imaging systems such as shown in U.S. Pat. Nos. 4,460,681 and 4,374,921.

The Image-Receiving Layer

When the reactants and reaction products of photothermographic and thermographic systems that contain compounds capable of being oxidized to form or release a dye remain in contact after imaging, several problems can result. For example, thermal development often forms turbid and hazy color images because of dye contamination by the reduced metallic silver image on the exposed area of the emulsion. In addition, the resulting prints tend to develop color in unimaged background areas. This is often referred to as "leuco dye backgrounding." This "background stain" is caused by slow post-processing reaction between the dye-forming or dye-releasing compound and reducing agent. It is therefore desirable to transfer the dye formed upon imaging to a receptor, or image-receiving layer.

Thus, the photothermographic or thermographic element may further comprise an image-receiving layer. Images derived from the photothermographic elements employing compounds capable of being oxidized to form or release a dye, such as, as for example, leuco dyes, are typically transferred to an image-receiving layer.

If used, dyes generated during thermal development of light-exposed regions of the emulsion layers migrate under development conditions into the an image-receiving or dye-receiving layer wherein they are retained. The dye-receiving layer may be composed of a polymeric material having affinity for the dyes employed. Necessarily, it will vary depending on the ionic or neutral characteristics of the dyes.

The image-receiving layer can be any flexible or rigid, transparent layer made of thermoplastic polymer. The image-receiving layer preferably has a thickness of at least 0.1 μm more preferably from about 1–10 μm, and a glass transition temperature ($T_g$) of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinyl chloride-vinyl acetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably, from 1.5 to 3.5) or a transmission optical density in the range of from 0.2 to 2.5 (preferably, from 1.0 to 2.5) is desirable.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image-receiving layers are described in U.S. Pat. No. 4,594,307.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02–0.5 weight percent of the emulsion layer, preferably from about 0.1–0.3 weight percent. A representative example of such a fluoroaliphatic polyester is "Fluorad FC 431", (a fluorinated surfactant available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer in order to facilitate transfer of the dye that forms after the imagewise exposed emulsion layer is subjected to thermal development, for example, in a heated shoe-and-roller-type heat processor.

Photothermographic multi-layer constructions containing blue-sensitive emulsions containing a yellow dye-forming or dye-releasing compound can be overcoated with green-sensitive emulsions containing a magenta dye-forming or dye-releasing compound. These layers can in turn be overcoated with a red-sensitive emulsion layer containing a cyan dye-forming or dye-releasing compound. Imaging and heating to form or release the yellow, magenta, and cyan dyes in an imagewise fashion. The dyes so formed or released may migrate to an image-receiving layer. The image-receiving layer can be a permanent part of the construction or it can be removable, "i.e., strippably adhered," and subsequently peeled from the construction. Color-forming layers can be maintained distinct from each other by the use of functional or non-functional barrier layers between the various photosensitive layers as described in U.S. Pat. No. 4,460,681. False color address, such as that shown in U.S. Pat. No. 4,619,892, can also be used rather than blue-yellow, green-magenta, or red-cyan relationships between sensitivity and dye formation or release. False color address is particularly useful when imaging is performed using longer wavelength light sources, especially red or near infrared light sources, to enable digital address by lasers and laser diodes.

If desired, the dyes formed or released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of about 0.5–300 seconds at a temperature of about 80°–220° C.

In another embodiment, a multi-colored image can be prepared by super-imposing in register a single image-receiving sheet successively with two or more imagewise exposed photothermographic elements, each of which forms or releases a dye of a different color, and heating to transfer the thus formed or released dyes as described above. This method is particularly suitable for the production of color proofs especially when the dyes formed or released have hues that match the internationally agreed standards for color reproduction (Standard Web Offset Printing colors or SWOP colors). Dyes with this property are disclosed in U.S. Pat. No. 5,023,229. In this embodiment, the photothermographic elements are preferably all sensitized to the same wavelength range regardless of the color of the dye formed or released. For example, the elements can be sensitized to ultraviolet radiation with a view toward contact exposure on conventional printing frames, or they can be sensitized to longer wavelengths, especially red or near infra-red, to enable digital address by lasers and laser diodes. As noted above, false color address is again particularly useful when imaging is performed using longer wavelength light sources, especially red or near infrared light sources, to enable digital address by lasers and laser diodes.

Reasonable modifications and variations are possible from the foregoing disclosure without departing from either the spirit or scope of the invention as defined by the claims. Objects and advantages of this invention will now be illustrated by the following examples, but the particular materials and amounts thereof recited in these examples, as well as other conditions and details, should not be construed to unduly limit this invention.

EXAMPLES

All materials used in the following examples were readily available from standard commercial sources such as Aldrich Chemical Co. (Milwaukee, Wis.) unless otherwise specified. The following additional terms and materials were used.

2-(2-methoxyethoxy)acetic acid (used to prepare Compound 4) and 2-[2-(2-methoxyethoxy)ethoxy]acetic acid (used to prepare Compound 5) were obtained from Fluka Chemical Company, Buchs, Switzerland.

Other alkoxy-carboxylic acids were obtained from Aldrich Chemical Co.

Butvar™ B-72 is a polyvinyl butyral available from Monsanto Company, St. Louis, Mo.

PET is polyethylene terephthalate.

PHZ is phthalazine, 4,5-benzo-1,2-diazine.

CAO-5 is bis(2-hydroxy-3-t-butyl-5-methylphenyl-)methane, an antioxidant available from Rohm and Haas, Philadelphia, Pa. It is used as a developer for photothermographic and thermographic elements and has the structure shown below:

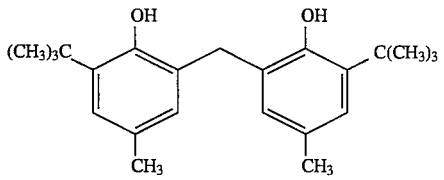

CAO-5

Vinol 523 is a polyvinyl alcohol.

VYNS is a vinyl chloride/vinyl acetate copolymer available from Union Carbide.

Preparation of silver alkoxy-carboxylate compounds:

Silver alkoxy-carboxylates were prepared by reaction of the sodium salt of the corresponding alkoxy-carboxylic acid with silver nitrate. The preparation of $CH_3CH_2$—O—$CH_2COO^-Ag^+$ ($R^1$, $R^2$=H; $R^3$=$CH_3CH_2$; L= a single bond; X=O; n=0) is illustrative. To 80 ml water, 0.90 g of $CH_3CH_2$—O—$CH_2COOH$ was added, followed by 0.27 g NaOH, and a solution of 1.13 g $AgNO_3$ dissolved in 20 ml of water. The colorless solid was filtered, washed, and air dried. The compound is very soluble in acetone and tetrahydrofuran.

Because of the extremely high solubility of the compounds of Formula (I) where n is greater than or equal to 2, a slightly different procedure was used. Silver nitrate (1.68 g) was dissolved in 25 mL of acetonitrile. Triethylorthoformate (1 mL) was added followed by 1.84 g of 2-[2-(2-methoxyethoxy)ethoxy]acetic acid (used to prepare Compound 5) and 1.01 g of triethyl amine. Filtration to remove triethylammonium nitrate was followed by solvent removal at reduced pressure to afford the silver salt. This material has a solubility greater than 0.1 mol/L in acetone, toluene, and water.

In contrast, a comparative non-alkoxy compound, silver butyrate, $CH_3CH_2CH_2COO^-Ag^+$ is not soluble in acetone or tetrahydrofuran.

Additional silver alkoxy-carboxylates were prepared in an analogous manner.

EXAMPLE 1

The following example demonstrates the use of silver alkoxy-carboxylates in a thermographic element.

A mixture of 7.0 g of silver-carboxylate and 7.0 g of a 5% solution of polyvinyl butyral (Butvar™ B-72) in ethanol were milled by shaking with glass balls in the dark for 2 hr. The resultant solution was coated onto a 4 mil (101.6 μm) clear polyester support using a #40 wire wound rod (Meyer Rod). The samples were dried in an oven at 80° C. for 2 minutes and cut into 1 inch by 6 inch strips (2.54 cm×15.24 cm). The strips were streaked with a 2% solution of CAO-5 developer in ethanol, or an ethanolic solution of CAO-5 developer and PHZ toner (2% each) and air dried. The samples were placed on a thermal wedge (Reichert Hot Bench™) for 15 seconds, removed, and rapidly brought to room temperature by placing on the surface of a laboratory bench. The temperature for the onset of thermal imaging and approximate $D_{max}$ were measured. The results, shown in Table 1, demonstrate the effectiveness of silver alkoxy-carboxylates in thermal constructions.

In the table below, $T_{onset}$ is the Temperature at which darkening of the sample began, and $T_{Dmax}$ is the temperature at which maximum darkening of the sample was achieved. Samples prepared with and without toner were evaluated.

TABLE 1

Silver Alkoxy-carboxylates in Thermal Constructions

| Ex. | Compound | $T_{onset}$ °C. | $T_{Dmax}$ °C. | Toner |
|---|---|---|---|---|
| 1-1 | Compound 1 | 130 | 145 | none |
| 1-2 | Compound 2 | 125 | 140 | none |
| 1-3 | Compound 3 | >140 | — | none |
| 1-4 | Compound 5 | 95 | 120 | none |
| 1-5 | Compound 1 | Room temp. | — | phthalazine |
| 1-6 | Compound 2 | Room temp. | — | phthalazine |
| 1-7 | Compound 3 | Room temp. | — | phthalazine |
| 1-8 | Compound 5 | 100 | 150 | phthalazine |

EXAMPLE 2

The following procedure was used to prepare an imaging construction in situ, that is, without isolating the intermediate silver complex. A 1:1 mole ratio of alkoxy-carboxylic acid and sodium hydroxide were mixed in a 5% solution of polyvinyl alcohol (Vinol 523) in water. A stoichiometric amount of silver nitrate was added and the reaction stirred to achieve solution. The solution was coated using a knife coater at a wet thickness of 4 mil (101.6 μm) on 4 mil polyester and allowed to air dry. A crystal clear film resulted. Thermal reactivity was determined as described above.

The results, shown in below in Table 2A demonstrate that thermographic elements can be prepared using silver alkoxy-carboxylate complexes generated in situ.

TABLE 2A $CH_3O$—$(CH_2$—$CH_2$—$O)_n$—$CH_2COO^-$ $Ag^+$ prepared in situ

| Ex. | n | $T_{onset}$ °C. | $T_{Dmax}$ °C. | Toner |
|---|---|---|---|---|
| 2-1 | 1 | 140 | 155 | none |
| 2-2 | 2 | 130 | 140 | none |
| 2-3 | 1 | 150 | 160 | phthalazine |
| 2-4 | 2 | 120 | 130 | phthalazine |

Comparative coatings, labeled 2C-1 to 2C-4 and using silver decanoate and silver hexanoate dispersions, were prepared and coated as described above. These compounds have chain lengths comparable to those of the silver alkoxy-carboxylate compounds of the invention. Films employing each of these compounds had a white, opaque appearance indicating poor solubility of the silver decanoate and silver hexanoate in the polyvinyl alcohol/water solvent mixture. The imaging properties of these films, shown below in Table 2B imaged in the manner typical for known constructions.

TABLE 2B

| | $CH_3—(CH_2)_p—COO^- Ag^+$ prepared in situ | | | |
|---|---|---|---|---|
| Ex. | p | $T_{onset}$ °C. | $T_{Dmax}$ °C. | Toner |
| 2C-1 | 4 | 130 | 150 | none |
| 2C-2 | 8 | 120 | 140 | none |
| 2C-3 | 4 | Room temp. | — | phthalazine |
| 2C-4 | 8 | 100 | 130 | phthalazine |

EXAMPLE 3

The following example demonstrates the use of silver alkoxy-carboxylates in a color-imaging construction. Thermographic elements prepared in Examples 1 and 2 above, were streaked with a 2% solution of leuco dye in ethanol or tetrahydrofuran and air dried. The samples were placed on a thermal wedge (Reichert Hot Bench™) for 6 seconds and immediately thermally quenched on a laboratory bench at room temperature. The temperatures for the onset of thermal imaging and approximate $D_{max}$ were measured. The results are shown in the attached table and demonstrate the simple constructions possible for the thermally activated imaging properties of these novel silver alkoxy-carboxylate compounds for photothermographic and thermographic color imaging.

The leuco dyes tested have the following structures:

Leuco Dye-1 is an leuco oxazine dye described in U.S. Pat. No. 4,782,010.

Leuco Dye-2 is a leuco benzimidazole dye and is described in U.S. Pat. No. 3,985,565.

Leuco Dye-3 is a hydroquinone leuco dye and is described in U.S. Pat. No. 4,460,681.

Leuco Dye-4 is a leuco ketazine dye described in U.S. Pat. Nos. 4,587,211 and 4,795,697.

| Ex. | Sample | Leuco Dye | $T_{onset}$ °C. | $T_{Dmax}$ °C. | Color |
|---|---|---|---|---|---|
| 3-1 | 2-2 | 1 | RT | — | cyan |
| 3-2 | 1-2 | 1 | 95 | 120 | deep blue |
| 3-3 | 2-2 | 2 | 130 | 135 | green |
| 3-4 | 1-2 | 2 | 100 | 115 | yellow |
| 3-5 | 2-2 | 3 | 95 | 100 | gold-yellow |
| 3-6 | 1-2 | 3 | RT | — | black |
| 3-7 | 2-2 | 4 | 110 | 130 | magenta |
| 3-8 | 1-2 | 4 | RT | — | magenta |

RT = room temperature

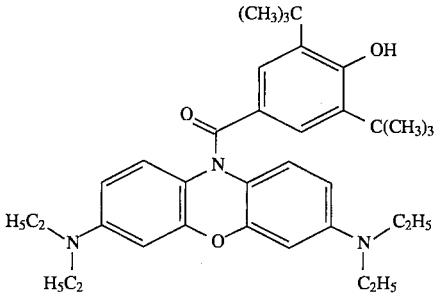

Leuco Dye-1

-continued

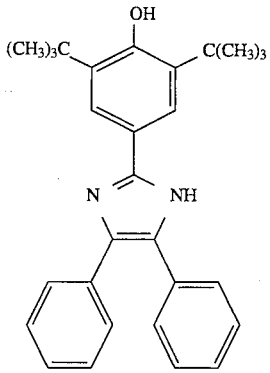

Leuco Dye-2

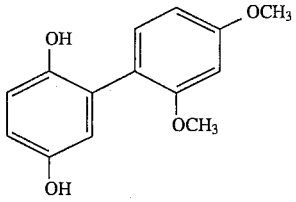

Leuco Dye-3

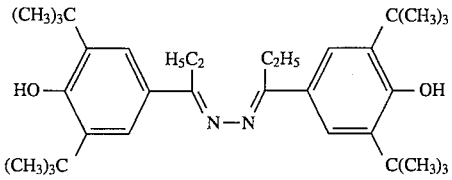

Leuco Dye-4

EXAMPLE 4

The following example demonstrates the use of silver alkoxy-carboxylate compounds of this invention in a photothermographic element.

Silver nitrate (0.176 g) and 2-[2-(2-methoxyethoxy-)ethoxy]acetic acid (0.170 g) were dissolved in 10.0 g of a 5% solution of polyvinyl alcohol (Vinol 523) in water. Addition of 1.0 g of an aqueous sodium hydroxide solution (prepared by dissolving 0.10 g of sodium hydroxide in 1.0 g of water) was followed by addition of 1.0 g of zinc bromide solution (prepared by dissolving 0.17 g of zinc bromide in 10.0 mL of methanol). A knife coater was used to coat the mixture. Red safe lights were used. The mixture was coated with the gap set at 3 mil (76.2 μm) onto a 4 mil (101.6 μm) clear polyester support. The coating was dried in air for 15 min and then dried in an oven at 80° C. for 8 min. This material was inherently sensitive to ultraviolet radiation as it contained silver bromide prepared in situ.

The dried film was then overcoated with a topcoat solution prepared from the following materials:

| Component | Amount |
|---|---|
| CAO-5 | 0.72 g |
| PHZ | 0.26 g |
| 2-butanone | 30. g |
| VYNS | 6. g |

The solution was coated using a #24 wire wound rod (Meyer bar) and allowed to dry in air.

Samples were exposed using a microfiche duplicator for 20 sec. One half of the sample was covered with a black sheet of paper. The other half of the sample was exposed. The sample was developed on a heated drum-type processor at 240° F. (115.6° C.) for 8 sec. The exposed area developed (i.e. turned black), while the unexposed area remained clear.

EXAMPLE 5

The following example demonstrates the use of silver alkoxy-carboxylate compounds of this invention in a thermographic element.

Compound 2 (0.5 g) and 10 g of a 5% solution of Butvar™ B-76 polyvinyl butyral resin in ethanol were shaken in a jar with glass balls for 2 hr. A knife coater was used to coat the mixture. The mixture containing, both dissolved and undissolved Compound 2, was coated 3 mil (76.2 μm) wet thickness onto a 4 mil (101.6 μm) clear polyester support. The coating was dried in air for 15 min and then dried in an oven at 65 ° C. for 1 min.

The dried film was then overcoated with a topcoat solution prepared by dissolving 0.72 g of CAO-5 in 36 g of a 7% solution of VYNS in 2-butanone. The topcoat solution was coated using a #26 wire wound rod (Meyer bar) to give a topcoat thickness of 2.34 mil (59 μm) and allowed to dry in air.

A sheet of the thermographic element was evaluated as a thermal imaging system. An electronic signal was used to drive the thermal head of an Atlantek Thermal Response Tester, Model 200. The machine has a 300 dots/inch printhead and was set at 15.5 volts, 1156 ohms, an "on time" of 3 ms, and a "cycle time" of 25 ms. Both text and checkerboard patterns were achieved.

EXAMPLE 6

Table 3 compares the solubility of Compound 5 of this invention in various organic solvents. The solubility of silver laurate and silver behenate are taken from values reported in the literature. As shown below, Compound 5 used in the photographic and thermographic elements of this invention has a solubility about 1,000 to 10,000 times that of silver laurate or silver stearate.

TABLE 3

Solubility of Silver Salts in Various Organic Solvents (mol/L)

| Solvent | Silver Laurate[1] | Silver Stearate[1] | Compound 5 |
|---|---|---|---|
| Water | $1.13 \times 10^{-5}$ | $0.72 \times 10^{-5}$ | $>1. \times 10^{-1}$ |
| Toluene | $1.19 \times 10^{-5}$ | $2.12 \times 10^{-5}$ | $>1. \times 10^{-1}$ |
| Acetone | $2.16 \times 10^{-5}$ | $2.91 \times 10^{-5}$ | $>1. \times 10^{-1}$ |
| Ethanol | $25.01 \times 10^{-5}$ | $22.13 \times 10^{-5}$ | $>>1. \times 10^{-1}$ |

[1]W. U. Malik et al. J. Chem. Soc. (A) 1971, 1514.

Reasonable modifications and variations are Possible from the foregoing disclosure without departing from either the spirit or scope of the Present invention as defined by the claims.

What is claimed is:

1. A photothermographic element comprising a support bearing at least one heat-developable, photosensitive, image-forming photothermographic emulsion layer comprising:

(a) a photosensitive silver halide;

(b) a non-photosensitive, reducible source of silver comprising a silver carboxylate compound of the formula $$R^3—X—(CH_2—CH_2—X)_n—L—CR^1R^2—COO^{-+}Ag$$

wherein:

$R^1$ and $R^2$ are each independently hydrogen, halogen, an alkyl group, or an aryl group;

$R^3$ is an alkyl group, an aryl group, or $L—CR^1R^2—COO^{-+}Ag$;

L is a linking group that links $CR^1R^2$ to X;

X is selected from the group consisting of O, S, and $NR^4$, wherein $R^4$ is chosen from alkyl, substituted alkyl, aromatic, or substituted aromatic; and n is an integer from 0 to 12;

(c) a reducing agent for the non-photosensitive, reducible source of silver; and (d) a binder.

2. The photothermographic element of claim 1 wherein said reducing agent for said non-photosensitive reducible source of silver comprises a compound capable of being oxidized to form or release a dye.

3. The photothermographic element of claim 2 wherein said compound capable of being oxidized to form or release a dye is a leuco dye.

4. The photothermographic element of claim 1 wherein $R^1$ and $R^2$ are independently hydrogen or alkyl groups having from 1 to 4 carbon atoms.

5. The photothermographic element of claim 4 wherein $R^1$ and $R^2$ are hydrogen.

6. The photothermographic element of claim 1 wherein X is oxygen.

7. The photothermographic element of claim 1 wherein L is selected from the group consisting of a single bond, $CH_2$, $CR^1R^2$, and an arylene group.

8. The photothermographic element of claim 7 wherein L is a single bond.

9. The photothermographic element of claim 1 wherein $R^3$ is an alkyl group having from 1 to 4 carbon atoms.

10. The photothermographic element of claim 1 wherein n is an integer from 0 to 5.

11. The photothermographic element of claim 1 wherein $R^1$ and $R^2$ are hydrogen, $R^3$ is an alkyl group having from 1 to 4 carbon atoms, X is O, L is a single bond, and n is 0, 1, or 2.

12. A thermographic element comprising a support coated with an imaging layer comprising:

(a) a non-photosensitive, reducible source of silver comprising a silver carboxylate compound of the following formula:

$$R^3—X—(CH_2—CH_2—X)_n—L—CR^1R^2—COO^{-+}Ag$$

wherein:

$R^1$ and $R^2$ are each independently represent hydrogen, halogen, an alkyl group or an aryl group;

$R^3$ is an alkyl group, an aryl group, $L—CR^1R^2—COO^{-+}Ag$;

L is a linking group that links $CR^1R^2$ to X;

X is selected from the group consisting of O, S, and $NR^4$, wherein $R^4$ is chosen from alkyl, substituted alkyl, aromatic, or substituted aromatic; and n is an integer from 0 to 12;

(b) a reducing agent for the non-photosensitive, reducible source of silver; and (c) a binder.

13. The thermographic element of claim 12 wherein said reducing agent for said non-photosensitive reducible source of silver comprises a compound capable of being oxidized to form or release a dye.

14. The thermographic element of claim 13 wherein said compound capable of being oxidized to form or release a dye is a leuco dye.

15. The thermographic element of claim 12 wherein $R^1$ and $R^2$ are independently hydrogen or alkyl groups having from 1 to 4 carbon atoms.

16. The thermographic element of claim 15 wherein $R^1$ and $R^2$ are hydrogen.

17. The thermographic element of claim 12 wherein X is oxygen.

18. The thermographic element of claim 12 wherein L is selected from the group consisting of a single bond, $CH_2$, $CR^1R^2$, and an arylene group.

19. The thermographic element of claim 18 wherein L is a single bond.

20. The thermographic element of claim 12 wherein $R^3$ is an alkyl group having from 1 to 4 carbon atoms.

21. The thermographic element of claim 12 wherein n is an integer from 0 to 5.

22. The thermographic element of claim 12 wherein $R^1$ and $R^2$ are hydrogen, $R^3$ is an alkyl group having from 1 to 4 carbon atoms, X is O, L is a single bond, and n is 0, 1, or 2.

* * * * *